United States Patent [19]

Ostberg

[11] 4,111,638

[45] Sep. 5, 1978

[54] CIGARETTE LIGHTER

[76] Inventor: Henry D. Ostberg, 278 Fountain Rd., Englewood, N.J. 07631

[21] Appl. No.: 715,119

[22] Filed: Aug. 17, 1976

[51] Int. Cl.[2] ..... F23Q 2/08

[52] U.S. Cl. ..... 431/13

[58] Field of Search ..... 431/14, 344, 13, 17, 431/253

[56] References Cited

U.S. PATENT DOCUMENTS

| | | | |
|---|---|---|---|
| 3,280,597 | 10/1966 | McLarty | 431/13 X |
| 3,735,099 | 5/1973 | Herr | 431/253 X |
| 3,744,953 | 7/1973 | Herr | 431/13 |

*Primary Examiner*—Edward G. Favors
*Attorney, Agent, or Firm*—Jacob L. Kollin

[57] ABSTRACT

A cigarette lighter provided with a mechanism which may be preset to restrict the number of cigarettes to be lighted during a given period. The mechanism comprises a rod and cooperating lever and a ratchet gear operated by opening the cover of the lighter. Numbered graduations for showing the number of cigarettes allowed for a given period of time are marked on the ratchet gear.

2 Claims, 7 Drawing Figures

CIGARETTE LIGHTER

BACKGROUND OF THE INVENTION

The invention relates to cigarette lighters in general and in particular to a cigarette lighter provided with a means for presetting the number of times the cigarette lighter can be actuated during a given period.

An important object of the invention is to provide a device of the above character which will enable a smoker to limit the number of cigarettes which he may consume daily or during any other period.

Another object of the invention is to provide such a device which is simple in construction and operation and inexpensive to manufacture.

These and other objects of the invention will become apparent from the following description in connection with the appended drawing illustrating a preferred embodiment of the invention. It is to be understood, however, that these are given by way of illustration and not of limitation and that changes may be made in the detail, construction, form and size of the parts, without affecting the scope of the invention sought to be protected.

Figure 1:
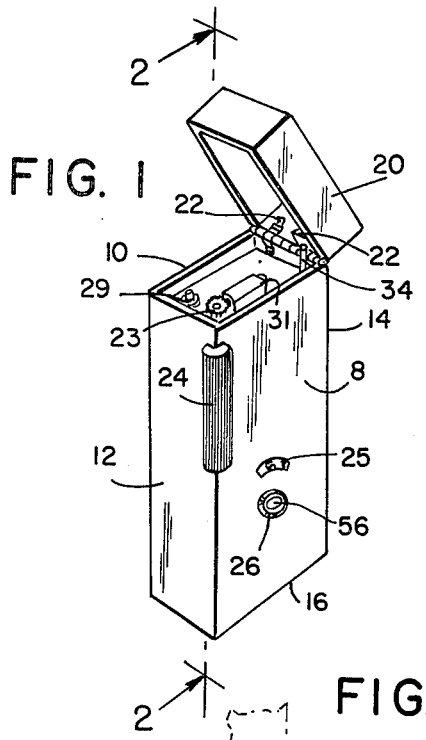
FIG. 1 is a perspective view of a cigarette lighter embodying the invention.
Figure 2:
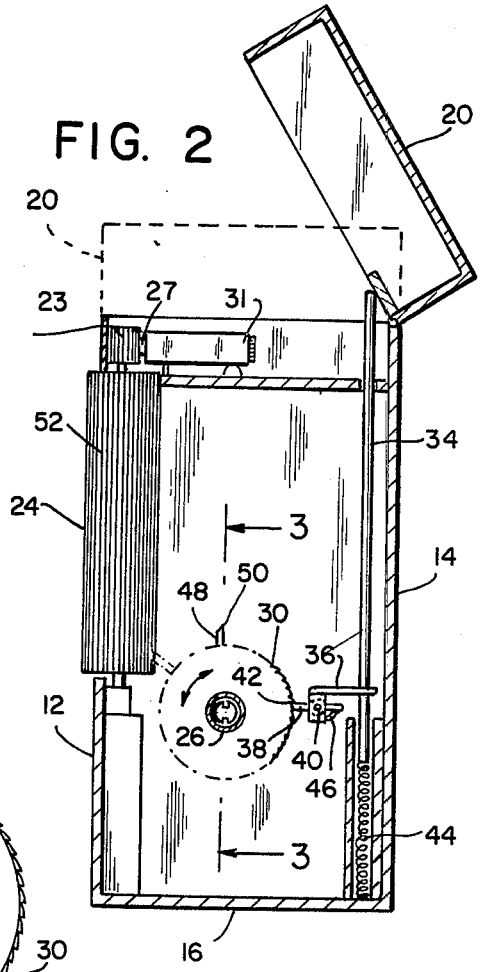
FIG. 2 is a cross-section taken on line 2—2 of FIG. 1.
Figure 5:
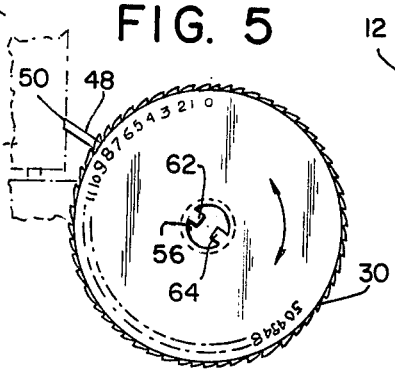
FIG. 5 illustrates the dial of the device.

Referring now to the drawing in detail, the novel cigarette lighter according to the invention, comprises a housing having side walls 8, 10 end walls 12, 14, bottom wall 16, an open top and a hinged cover 20, normally maintained in closed position shown in dotted lines in FIG. 2. The cover may be opened and closed manually and is maintained in the closed position by spring 22. The ignition mechanism for lighting the wick of the lighter comprises a ridged cylinder 24, rotatable by the smoker's thumb to actuate a friction wheel 23, a flint 27, the wick proper 29, a housing 31 for the flint and a coil spring (not shown).

The wall 8 is provided with a window 25 for indicating the maximum number of cigarettes desired to be smoked by the user during a certain period of time, such as a day, week, etc. There is further provided in wall 8 a bearing 66, in which is rotatably mounted a hollow shaft 56 on which is slidably mounted a ratchet gear 30 formed with indicating numerals 0–50 and with a pair of opposed teeth 62, 64, which extend into the shaft and are engageable with the slots of key 57, which is insertable into hollow shaft 56, for rotating ratchet gear 30 to a desired position for indicating the chosen number of cigarettes in window 25.

The gear 30 is further provided with an integral stop pin 48, which is engageable with any of the valleys 50 of cylinder 24, thus preventing its further turning by the user's thumb and lighting the lighter after the present number of cigarettes has been smoked, as will be further described.

Slidably mounted on wall 14 is a rod 34 formed with an integral dog 36, on the free end of which is pivoted a claw edge 42 which engages with the teeth of ratchet wheel 30. When the bottom end of rod 34 is in its extreme lowest position when cover 20 is closed, spring 46 biasing lever 38 and thus edge 42 against the teeth of ratchet wheel 30.

When cover 20 is opened, coil spring 44 forces rod 34 upwards, thus causing the lever 38 to push a tooth of the ratchet gear a distance corresponding to the following number on said gear. It will be apparent that closing cover 20 will not turn the ratchet gear. This operation is repeated every time the cover 20 is opened before lighting a cigarette, until the ratchet gear has turned to a point where pin 48 engages in a valley of cylinder 24. At this point the number on the ratchet wheel will be zero, indicating no further operation of the lighter possible, since stop pin 48 now prevents the cylinder from turning.

Figure 3:
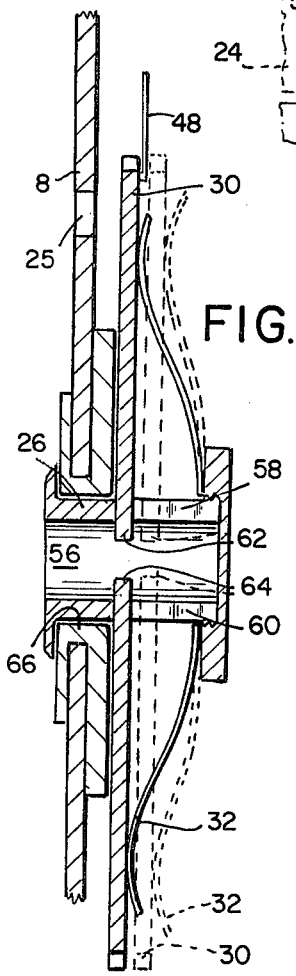
FIG. 3 is a cross-section taken on line 3—3 of FIG. 2.
Figure 7:
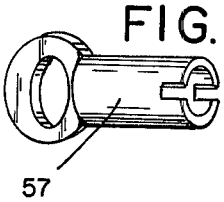
FIG. 7 is a perspective view of a key used with the device.
Figure 4:
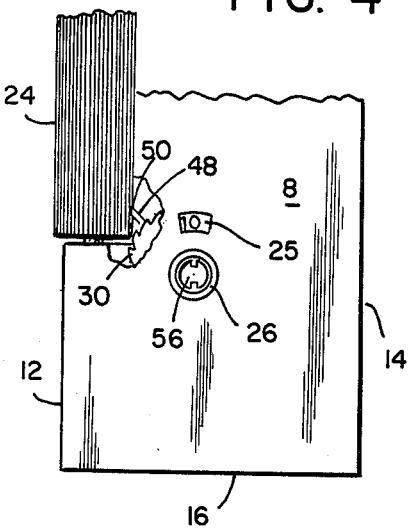
FIG. 4 is a partial elevational side view of one side of the lighter.
Figure 6:
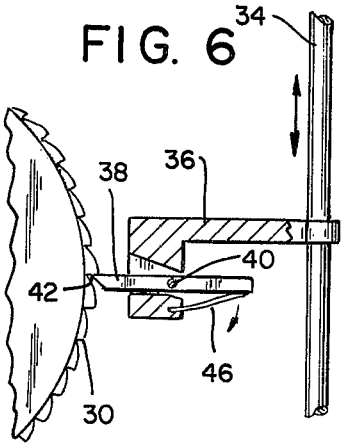
FIG. 6 illustrates a detail of the mechanism of the lighter.

To set the limit number of cigarettes, to be smoked, the key 57 is inserted in the shaft 56 engaged with teeth 62, 64 and gear 30 slid to the position shown in dotted lines in FIG. 3, against the bias of spring 32. This disengages the gear's teeth from the claw 38 and permits the rotation of the gear to a desired number, to be seen in the window 25, corresponding to the number of cigarettes to be smoked. The key is removed and placed, if possible, in a difficult to reach place, or any other desired place.

I claim:

1. A cigarette lighter, comprising, in combination, a lighter casing having a pair of side walls, a pair of end walls, a closed bottom, an open top, a hinged cover for said open top, lighting means for cigarettes in said casing, and means in said casing for presetting the total number of flames desired to be lighted during a predetermined period, said lighting means comprising a ridged cylinder mounted for rotation in said casing and projecting partly through one of said walls, a friction wheel mounted on one end of said cylinder, a spring loaded flint engageable with said friction wheel, mounted in said casing said means for presetting the total number of flames comprising a bearing mounted in a side wall adjacent said one end wall, a hollow shaft received in said bearing, a ratchet gear secured to said shaft and having indicating numerals thereon and provided with an integral stop pin extending from said gear's periphery, said gear being engageable with said ridged cylinder, said hollow shaft having a pair of radially inwardly directed opposed teeth engageably with a setting key having notches engageable with said teeth and a spring member for biasing the ratchet gear against said side wall.

2. The cigarette lighter as claimed in claim 1, further including a rod slidably mounted on the other of said end walls, an integral dog on said rod, a spring-loaded claw pivoted on said dog and engageable with said gear when the lower end of the rod is in extreme lowest position with the lighter cover closed, a coil spring biasing the upper end of said rod against said cover, thereby causing said claw to advance said ratchet gear a notch corresponding to a following number on the gear's face, thereby indicateng remaining number of cigarettes which could be ignited by said lighter.

* * * * *